US005327949A

United States Patent [19]

Dotson et al.

[11] Patent Number: 5,327,949

[45] Date of Patent: Jul. 12, 1994

[54] FUEL DISPENSING NOZZLE

[75] Inventors: Kenneth W. Dotson; Stewart Mac Harmon, both of Raleigh; Francis B. Weeks, Apex; Chih-Kun J. Shih, Cary; John L. Johnson, Raleigh, all of N.C.

[73] Assignee: Emco Wheaton, Inc., Cary, N.C.

[21] Appl. No.: 963,581

[22] Filed: Oct. 19, 1992

[51] Int. Cl.[5] ..... B65B 1/30; B65B 3/28; B65B 57/06; B65B 57/14

[52] U.S. Cl. ..... 141/206; 141/208; 141/218; 141/392

[58] Field of Search ..... 141/198, 206, 207, 208, 141/209, 218, 290, 301, 302, 305, 389, 392; 137/801; 251/368

[56] References Cited

U.S. PATENT DOCUMENTS

| | | | |
|---|---|---|---|
| Re. 30,050 | 7/1979 | Hansel | 141/208 |
| 2,840,122 | 6/1958 | Klikunas et al. | 141/207 |
| 2,874,735 | 2/1959 | Boone | 141/208 |
| 3,012,592 | 12/1961 | Wright et al. | 141/208 |
| 3,088,500 | 5/1963 | Payne | 141/208 |
| 3,259,154 | 7/1966 | Scherer | 141/209 |
| 3,603,359 | 9/1971 | Belue | 141/208 |
| 3,638,689 | 2/1972 | Ecklund | 141/214 |
| 3,805,828 | 4/1974 | Panagrossi | 251/368 |
| 3,900,056 | 8/1975 | Giardini et al. | 141/290 |
| 4,005,339 | 1/1977 | Plantard | 141/392 |
| 4,199,012 | 4/1980 | Lasater | 141/52 |
| 4,223,706 | 9/1980 | McGahey | 141/59 |
| 4,232,715 | 11/1980 | Pyle | 141/1 |
| 4,351,375 | 9/1982 | Polson | 141/98 |
| 4,429,725 | 2/1984 | Walker et al. | 141/59 |
| 4,566,504 | 1/1986 | Furrow et al. | 141/59 |
| 4,649,969 | 3/1987 | McMath | 141/290 |
| 4,796,678 | 1/1989 | Motohashi et al. | 141/208 |

*Primary Examiner*—Henry J. Recla
*Assistant Examiner*—Steven O. Douglas
*Attorney, Agent, or Firm*—Bell, Seltzer, Park & Gibson

[57] ABSTRACT

A fuel dispensing nozzle is disclosed and includes a housing having a hollow main body portion and a handle portion with a hand-grip spaced from the main body portion, an elongate nozzle body mounted in the main body portion of the housing and having a fuel passageway extending longitudinally therethrough in a generally straight line devoid of any abrupt changes in direction, main valve means disposed in the fuel passageway for controlling the flow of fuel through the nozzle, manually operable valve actuating means, a spout for insertion into the fill opening of a vehicle fuel tank and having three integrally formed passageways therethrough comprising a fuel passageway, a vapor recovery passageway and a shut-off, venturi-vacuum passageway, a vapor recovery passageway through the main body and handle portions of the housing, a venturi-vacuum means for shutting off the flow of fuel through the nozzle when the vehicle fuel tank is full, attitude responsive means for preventing the opening of the main valve when the nozzle is not in the proper attitude for insertion of the spout into the fill opening of the vehicle fuel tank and attitude responsive valve means in the vapor recovery passageway in the housing for closing the vapor recovery passageway when the nozzle is not in position for insertion of the spout into the fill opening of the vehicle fuel tank. The housing and nozzle body are molded of a composite resin and the spout is extruded of a lightweight metal.

21 Claims, 10 Drawing Sheets

Fig. 15.
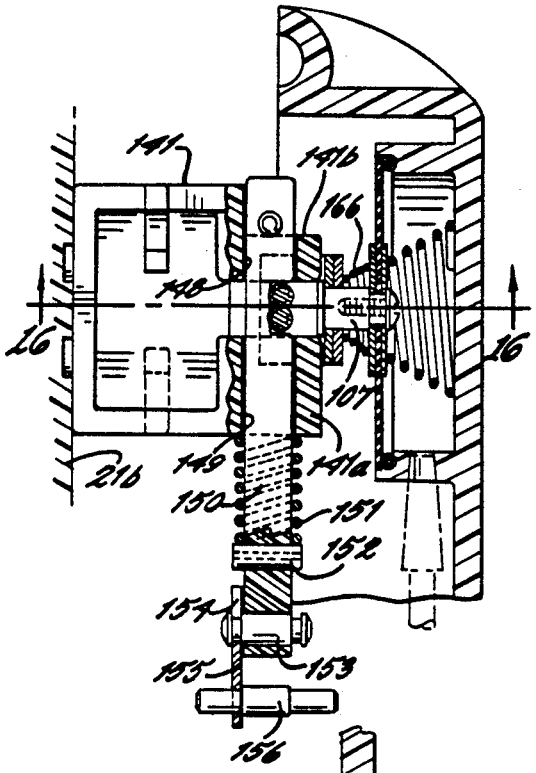
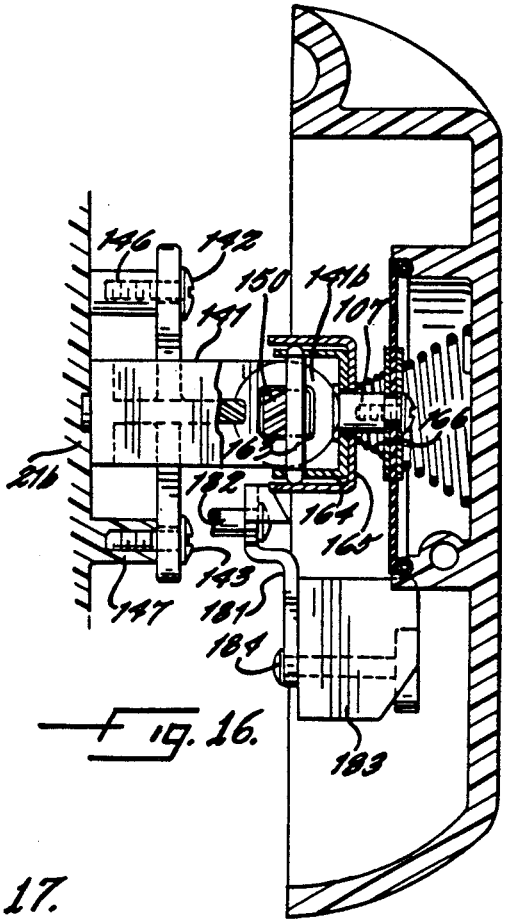
Fig. 16.
Fig. 17.
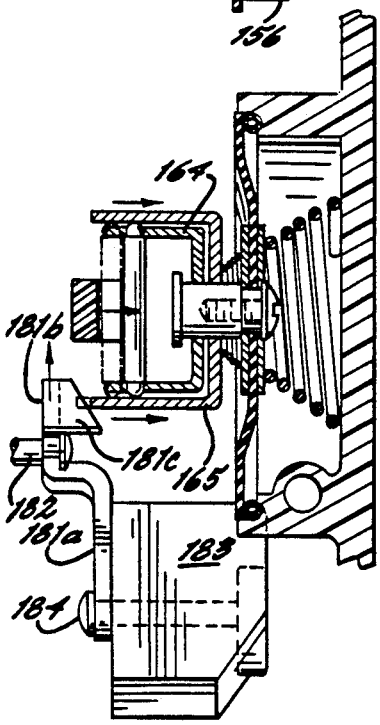
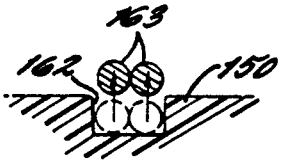
Fig. 18a.
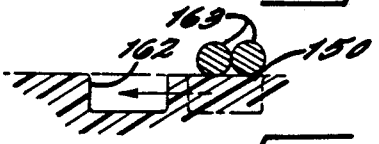
Fig. 18b.
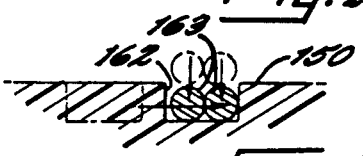
Fig. 18c.

FUEL DISPENSING NOZZLE

FIELD OF THE INVENTION

The present invention relates to fuel dispensing nozzles and more particularly to a fuel dispensing nozzle of the vapor recovery type.

BACKGROUND OF THE INVENTION

Fuel dispensing nozzles are utilized to deliver fuel into the fuel tank of a vehicle through a fill opening in the tank. Such nozzles typically include a main body portion, a spout connected and carried by the main body portion for insertion into the fill opening of the fuel tank on the vehicle and a connector portion for connecting the nozzle onto the outer end of a hose which delivers fuel from the pump to the nozzle. The main body portion includes a fuel passageway therethrough and a main poppet valve disposed within the passageway for controlling the dispensing of fuel through the nozzle.

Heretofore, the main body portion of the nozzle has been structured and configured such that the portion thereof opposite the spout serves as the handle for the nozzle and the user manipulates the nozzle by grasping the handle portion of the main body of the nozzle. An operating lever is pivotally mounted on the main body portion of the nozzle beneath the handle portion thereof. In such configuration, the main valve extends perpendicular to the longitudinal axis of the nozzle and the stem of the poppet valve extends outwardly and downwardly through the wall of the main body portion into position to be engaged by the trigger. Accordingly, when a user pulls upwardly on the operating lever the main poppet valve is opened and fuel is dispensed through the nozzle into the fuel tank of the vehicle.

With such prior fuel dispensing nozzles, fuel frequently runs down the spout and onto the main body portion of the nozzle and coats the handle portion. A user then has his or her hand soiled by such fuel. Additionally, the design of the nozzle makes the same difficult to manipulate from the hanger on the pump to the proper attitude for insertion of the spout into the fill opening of the vehicle fuel tank because such manipulation requires substantial flexing of the wrist.

Another major disadvantage of such prior fuel dispensing nozzles is impediments to the free flow of fuel through the fuel passageway in the nozzle because of several abrupt changes in direction and various operating mechanisms for the valves that are disposed within the fuel flow path. These changes in direction and obstructions significantly impede the flow of fuel through the nozzle and result in a higher pump pressure than would otherwise be required.

Environmental rules and regulations dictate that fuel dispensing nozzles in certain locations include the facility to recover fuel vapors that are displaced from the vehicle fuel tank as fuel is dispensed thereinto. Heretofore such vapor recovery nozzles have taken one of two forms. One form utilizes a flexible boot which surrounds the spout of the nozzle and defines a vapor recovery passageway externally of the spout and internally of the boot. This nozzle relies entirely upon the pressure of the fuel filling the vehicle tank to displace and force the vapor outwardly through the vapor recovering passageway within the flexible boot and back into the underground tank.

The second form of vapor recovery nozzle has the vapor recovery passageway disposed within the spout and such vapor recovery passageway is provided by a concentric tube mounted within the fuel dispensing spout. Such vapor recovery nozzles rely upon a vacuum assist for removal of the vapors from the vehicle fuel tank and the return of such vapors into the underground fuel tank. In addition to the fabrication difficulties posed by constructing the spout with concentric tubes or conduits, such prior nozzles typically have the vacuum assist operating on all nozzles attached to a particular pump if any one nozzle of that pump is in use. Such operation requires a much larger vacuum assist pump and wastes power.

Typically, fuel dispensing nozzles also include a shut-off mechanism which will interrupt the dispensing of fuel into the vehicle fuel tank when the tank is full. This safety feature prevents spillage of fuel onto the ground and contamination of both the air and the soil. Such shut-off mechanisms typically include a venturi device within the main body portion of the nozzle which is connected to the outer end of the spout by an internal passageway within the spout. In use, the flow of fuel through the nozzle creates a partial vacuum in this shut-off passageway which draws vapor out of the fuel tank, which continues so long as fuel is being dispensed and the shut-off passageway remains open. However, when the outer end of this shut-off passageway is blocked by fuel within the vehicle fuel tank, the flow of vapor ceases and the vacuum evacuates a chamber within the nozzle which causes the lever linkage to be disabled and permits the closing of the main poppet valve to interrupt the flow of fuel through the nozzle into the vehicle fuel tank.

As was the case with the vapor recovery tube or conduit, the shut-off passageway is typically a separate tube or conduit mounted within the spout. Such fabrication of the spout is labor intensive, time consuming and expensive.

With the foregoing in mind, it is an object of the present invention to provide a fuel dispensing nozzle that overcomes the disadvantages and deficiencies of prior fuel dispensing nozzles.

A more specific object of the present invention is to provide a fuel dispensing nozzle that is more user friendly and which is safer and more environmentally protective than prior fuel dispensing nozzles.

SUMMARY OF THE INVENTION

The foregoing objects of the present invention are accomplished by providing a fuel dispensing nozzle having a main body portion which has a fuel passageway extending longitudinally therethrough in a generally straight line devoid of any abrupt changes in direction. The main body portion has mounted in the fuel passageway a main poppet valve which moves longitudinally of the main body portion between its open and closed positions.

The main body portion has a connector portion at the ingress end thereof which is adapted to be connected to a hose for delivery of fuel to the nozzle from the pump. A spout is connected at the egress end of the main body portion and has integrally formed therein fuel dispensing, vapor recovery and shut-off passageways.

A housing encloses the main body portion in a main housing portion and has a handle portion extending outwardly from and in spaced relation to the main body portion. The handle portion includes a grasping or hand-grip portion adapted to be grasped by the hand of a user, which is in spaced relation to the main body portion such that the hand of the user does not come in contact with the portions of the nozzle through which fuel passes. The housing of the nozzle includes a shut-off venturi passage and a vacuum chamber which is connected through a conduit to the fuel flow passageway in the main body portion and to the shut-off passageway within the spout.

A trigger mechanism is mounted for pivotable movement on the main body portion and is connected through a linkage mechanism to the stem of the main poppet valve. An operating portion of the trigger mechanism extends outwardly through the main housing portion toward the handle portion in position to be engaged and manipulated by the finger or fingers of the hand of the user grasping the handle portion of the nozzle. The trigger linkage mechanism connecting the trigger to the main poppet valve includes a portion connected to a diaphragm on the venturi vacuum chamber such that when the shut-off passageway in the spout is blocked and the vacuum evacuates the chamber the diaphragm will disconnect the trigger mechanism from the main poppet valve and permit the main poppet valve to close.

The side of the handle portion of the housing facing the main body portion of the nozzle has a series of spaced projections adjacent the operating portion of the trigger mechanism. A hold-open clip is carried by the finger engaged portion of the trigger mechanism for coaction with the series of spaced projections to hold the trigger in operating position to hold the main poppet valve open when the clip and projections are engaged.

The nozzle of the present invention also includes an attitude responsive disconnect device connected to the trigger linkage mechanism. This attitude responsive device functions to disconnect the trigger linkage mechanism from the main poppet valve when the nozzle is in any attitude other than that where the nozzle is in position to have the spout inserted within the fill opening of the vehicle fuel tank. When the nozzle is in a vertical orientation as when it is resting in its hanger on the pump or when it is being replaced on the pump and handled in any manner other than with the spout pointing down, the attitude responsive device will disconnect the trigger linkage mechanism from the main poppet valve and prevent the main poppet valve from being inadvertently or accidentally opened and fuel dispensed through the nozzle.

In the preferred embodiment of the present invention, the fuel dispensing nozzle is of the vapor recovery type and has an integrally formed vapor recovery passageway provided in the spout of the nozzle. The vapor recovery passageway in the spout communicates through the open end thereof with the outer end of the spout and also laterally of the spout through holes provided in the outer wall of the spout into the vapor recovery passageway. The handle portion of the housing has a vapor recovery passageway provided therethrough which communicates with the vapor recovery passageway within the spout and through the connector portion of the main body portion of the nozzle with a vapor return passageway within the fuel delivery hose.

An attitude responsive valve is provided in the vapor recovery passageway within the handle portion of the nozzle such that when the nozzle is in any orientation other than that typical of having the spout within the fill opening of the vehicle fuel tank, the vapor recovery passageway through the handle portion of the nozzle housing is closed by the attitude responsive valve. In this manner, the vacuum assist cannot draw vapors or air through the nozzle except when the nozzle is in a proper position for use to dispense fuel into the vehicle fuel tank.

BRIEF DESCRIPTION OF THE DRAWINGS

Some of the objects and advantages of the present invention having been stated, others will appear as the description proceeds when considered in conjunction with the accompanying schematic drawings, in which:

FIG. 15 is an enlarged fragmentary sectional view illustrating the vacuum chamber for the vacuum shut-off mechanism and the attitude responsive disconnect mechanism;

FIG. 16 is a fragmentary sectional view taken substantially along line 16—16 in FIG. 15;

FIG. 17 is an enlarged fragmentary sectional detail of the vacuum chamber and attitude responsive disconnect mechanism;

FIGS. 18*a*, 18*b* and 18*c* are enlarged fragmentary sectional details illustrating the disconnect feature of the trigger linkage assembly;

DETAILED DESCRIPTION OF THE PREFERRED EMBODIMENT

Figure 1:
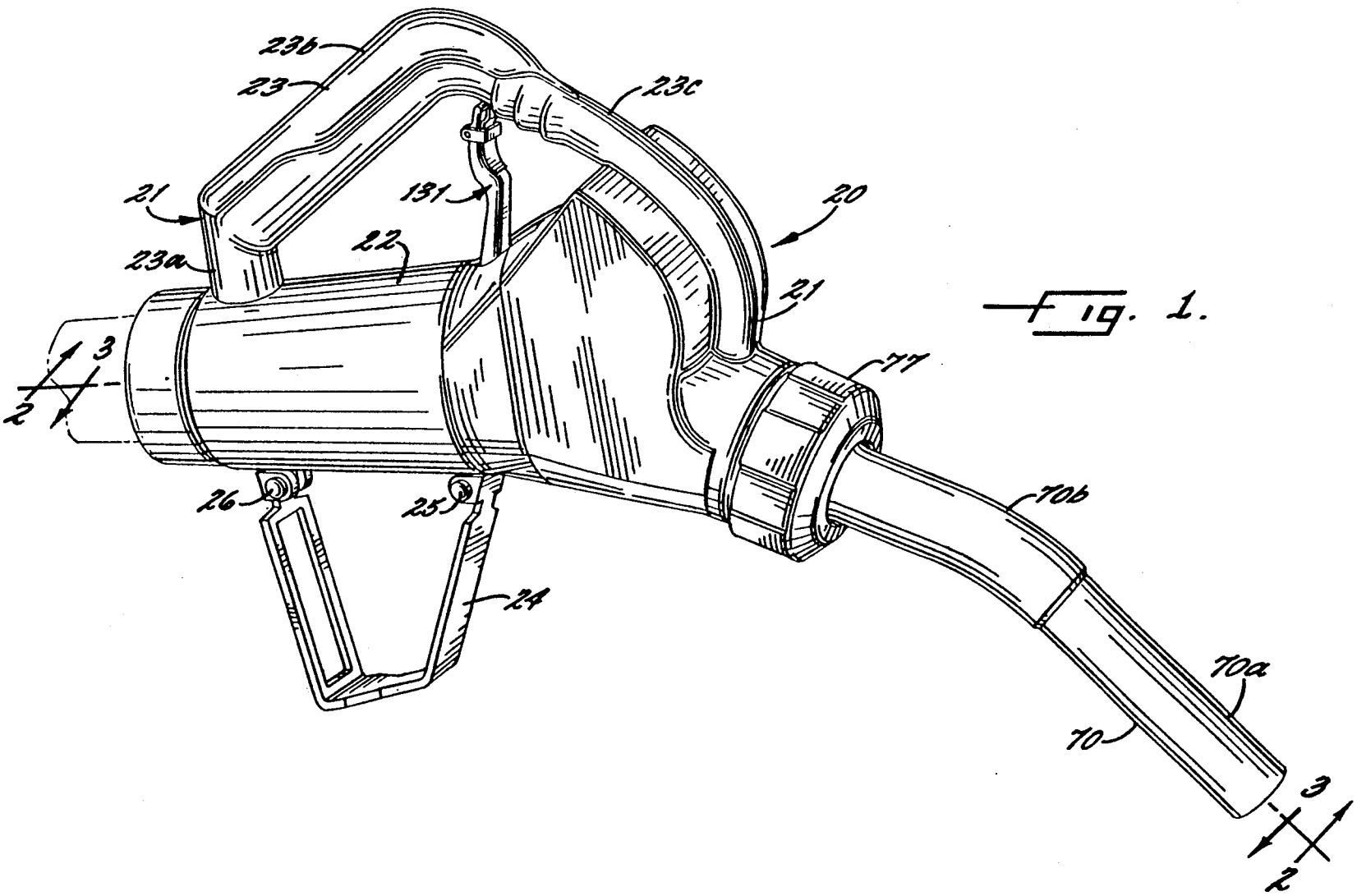
FIG. 1 is a perspective view of the nozzle of the present invention.

Referring now more particularly to the drawings wherein a preferred embodiment of the present invention is illustrated, the nozzle of the present invention is generally indicated at 20. The nozzle 20 comprises a housing 21 (FIGS. 1–3) which is preferably formed in two complementary halves 21*a*, 21*b* separated along the longitudinal center line of the housing 21. Preferably, each of the two halves of housing 21 are formed integral and may be constructed of any suitable material, but preferably are molded of a composite resin comprising a nylon 6 base and long glass fiber reinforcement. The complementary halves 21*a*, 21*b* may be secured together by any desired means, as by a suitable adhesive.

Figure 2:
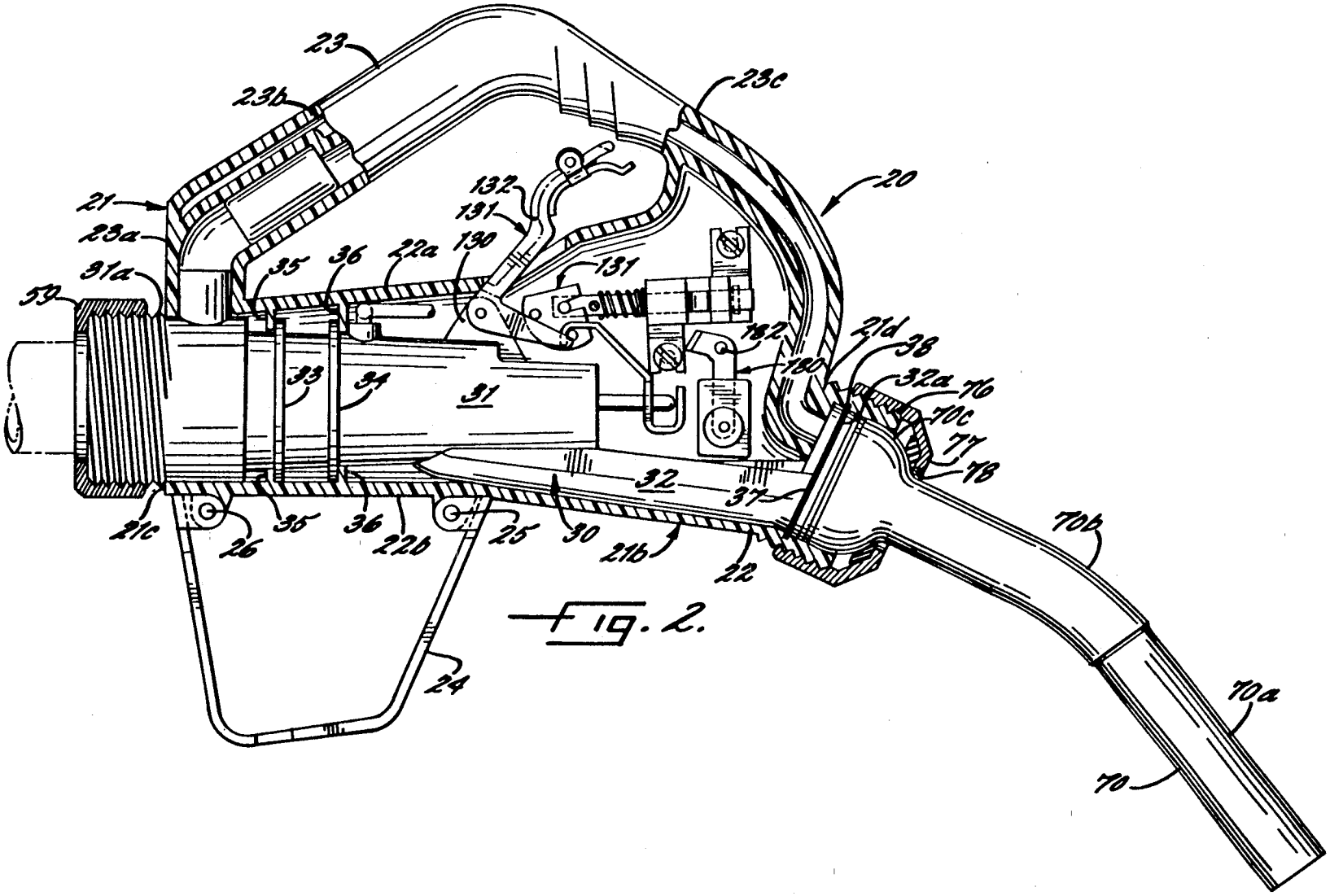
FIG. 2 is a longitudinal sectional view taken substantially along line 2—2 in FIG. 1 with a portion of the handle of the nozzle not in section.
Figures 3, 4:
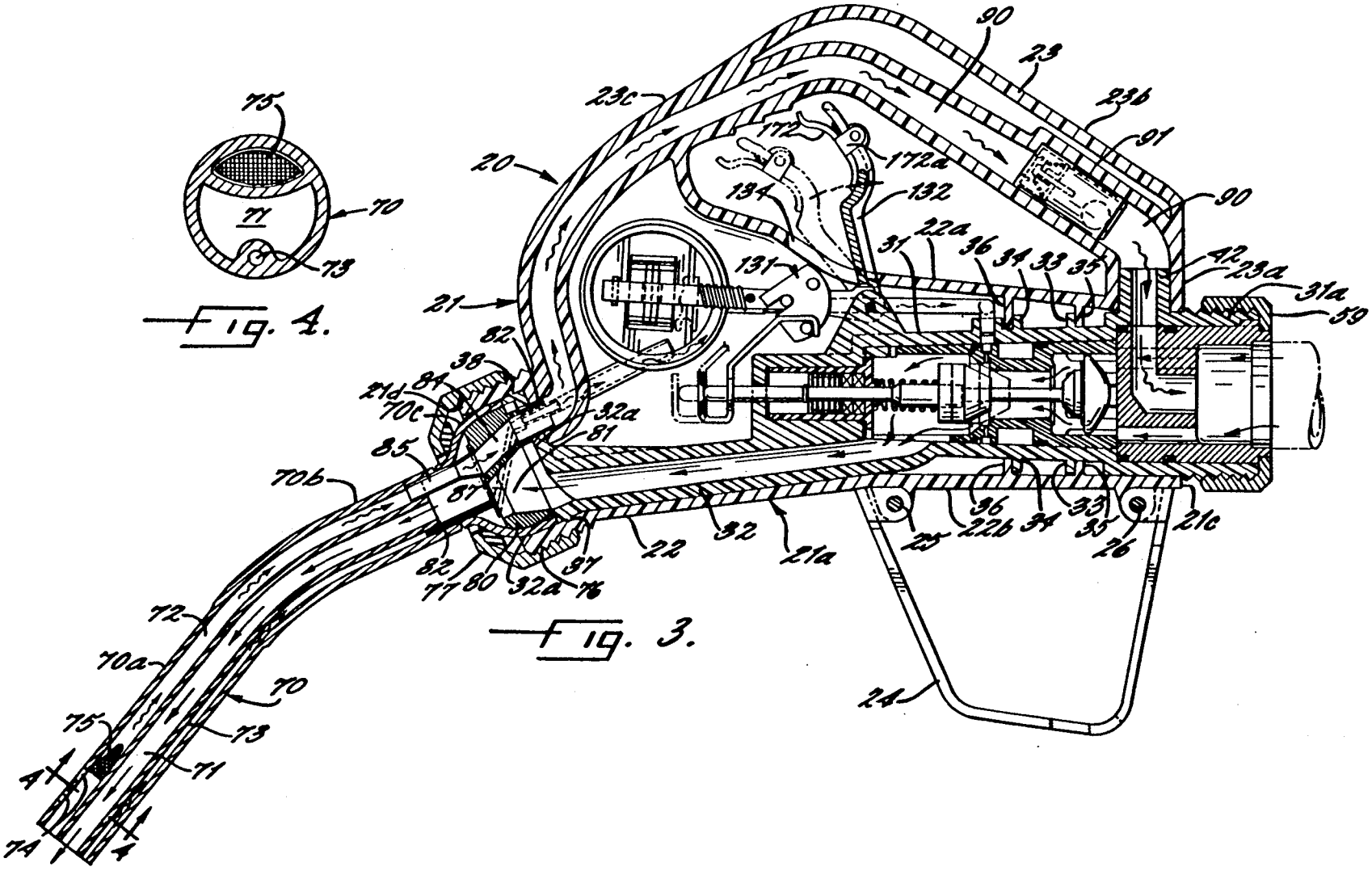
FIG. 3 is a longitudinal section taken substantially along line 3—3 in FIG. 1.
FIG. 4 is an enlarged transverse sectional view of the spout taken substantially along line 4—4 in FIG. 3.

The housing 21 includes a main housing body 22 and a handle 23. Main housing body 22 is hollow and defines a chamber therein open at its opposite ends (FIGS. 2 and 3). The shape of the main housing body 22 is dictated by the nozzle operating parts and assemblies confined therein or mounted thereon. It is noted, however, that such shape should be aesthetically pleasing as well as functional and should lend itself to molding with a minimum of operations, including assembly, being required thereafter.

Handle 23 is elongate and is formed integral with the main housing body 22 at opposite ends thereof (FIGS. 2 and 3). The medial portion of handle 23 is spaced outwardly from the upper wall 22*a* of the main housing body 22 a sufficient distance to permit the hand of a user to comfortably fit around the handle 23 and within the space between handle 23 and the top wall 22*a* of main housing body 22. Preferably, handle 23 has a generally straight vertical portion 23*a* which extends upwardly from the upper wall 22*a* of main housing body 22 adjacent the ingress end 21*c* of housing 21 for a predetermined distance. A grasping or hand-grip portion 23*b* extends upwardly and outwardly from the upper end of straight vertical portion 23*a* at an acute angle relative to the longitudinal axis of the main housing body 22 for reasons to be hereinafter described. Finally, handle 23 has a third portion 23*c* which extends outwardly and downwardly from the outer end of the hand-grip portion 23*b* to the main housing body 22 near the egress end 21*d* of housing 21 (FIGS. 2 and 3).

A hanger bracket 24 is mounted at its opposite ends on the bottom wall 22*b* of the main housing body 22 by suitable rivets or pins 25, 26. Pins 25, 26 may be removed to permit the removal of hanger bracket 24 and the replacement thereof by a hanger bracket of different configuration as dictated by the particular nozzle support mechanism on the service station pump with which nozzle 20 is to be used. While such pump hanger configurations are fairly uniform in the United States, service station pumps in other locales have hanger configurations that are significantly different for different types of pumps. The nozzle 20 of this invention has substantial versatility for use with pumps having different hanger configurations thereon.

The nozzle 20 further includes a nozzle body member 30 mounted and substantially enclosed in main housing body 22 of housing 21 (FIGS. 2 and 3). Nozzle body member 30 has a main valve portion 31 and a fuel delivery portion 32. Main valve portion 31 has an ingress end 31*a* extending through the ingress end 21*c* of housing 21 and which is adapted to be connected to a fuel delivery hose of a service station pump. Fuel delivery portion 32 of nozzle body member 30 is formed integral with main valve portion 31 and extends therefrom to the egress end 21*d* of housing 21. Fuel delivery portion 32 has an egress end 32*a* which is of larger diameter, corresponding to the internal diameter of the egress end 21*d* of housing 21 (FIGS. 2, 3, 5*a* and 5*b*).

Nozzle body member 30 has two spaced apart circumferential ribs 33, 34 which extend around a medial portion of main valve portion 31 (FIGS. 2, 3, 5*a* and 5*b*). Both halves of main housing body 22 have inwardly extending, complementary circumferential ribs 35, 36 which are spaced apart a distance equal to the spacing between the opposing outer surfaces of the circumferential ribs 33, 34 on main valve portion 31 such that when nozzle body 30 is positioned within housing body 22 the ribs 33, 34 will fit snugly between the ribs 35, 36 to hold the nozzle body member 30 in position within housing body 22 and against any movement including vibration therewithin.

Similarly, the egress end 32*a* of fuel delivery portion 32 has a circumferential rib 37 therearound which is received within a groove 38 in the inside surface of the egress end 21*d* of housing 21. When housing halves 21*a* and 21*b* are separated, it is a simple matter to place nozzle body member 30 within one half of the housing 21 (either half 21*a* or half 21*b*) and then to place the other half of the housing 21 thereover to snugly confine the nozzle body member 30 within the housing body 22.

Nozzle body member 30 may be constructed of any suitable material that is resistant to the fuels with which the nozzle 20 may be employed, but preferably is formed of a composite resin comprising a nylon 6 base with long glass fiber and carbon fiber reinforcement. Further, while nozzle body member 30 may be formed in any suitable manner, it is preferred that nozzle body member 30 be molded. With the present invention, machining of the molded nozzle body member 30 is not required.

Figures 5A, 5B:
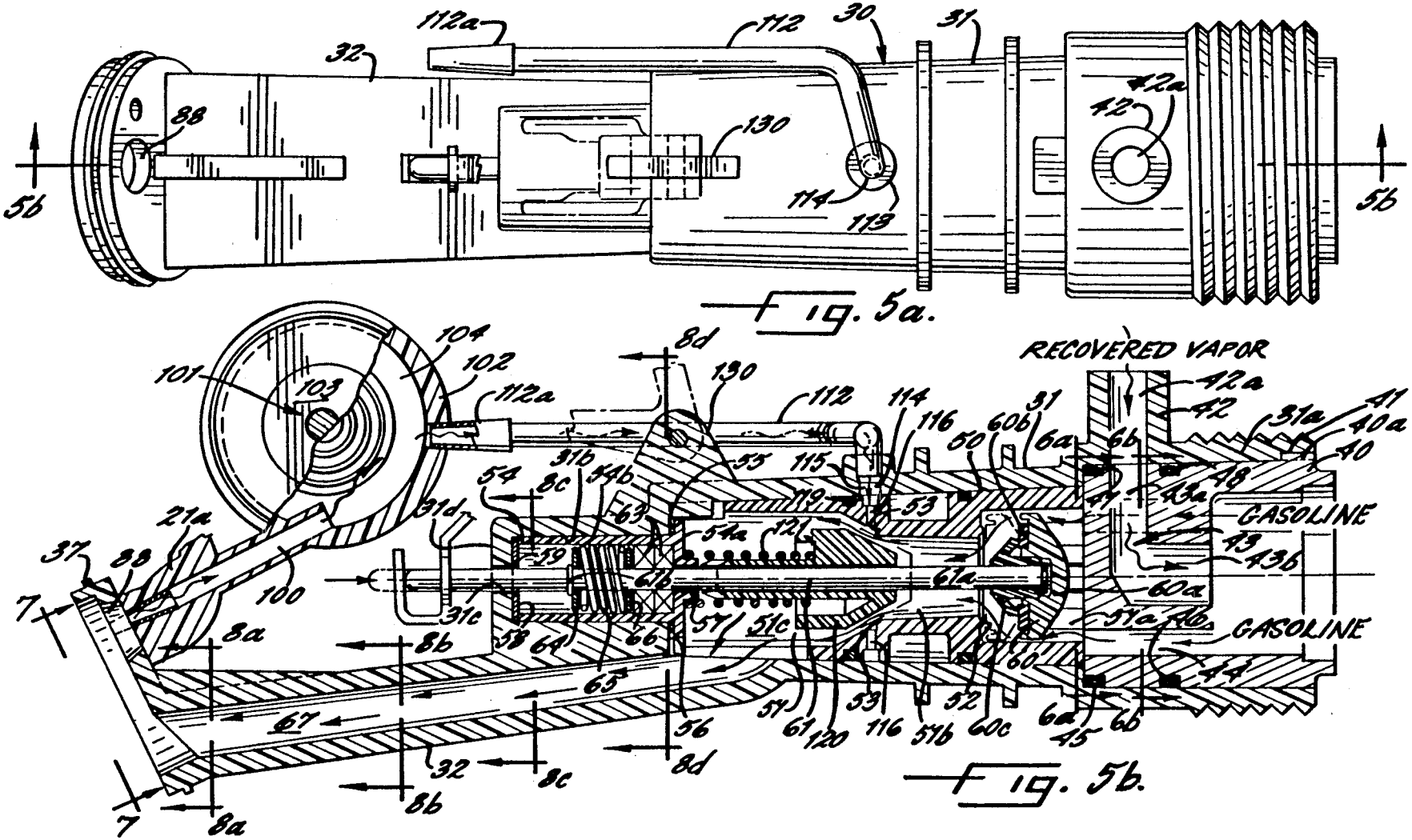
FIG. 5*a* is an enlarged top plan view of the main body portion of the nozzle shown in FIGS. 1 through 3.
FIG. 5*b* is a longitudinal sectional view of the main body portion taken substantially along line 5*b*—5*b* in FIG. 5*a;*

Valve portion 31 of the nozzle body member 30 is generally hollow with the interior thereof formed with cavity sections of various diameters, some of which are of constant diameter throughout and others of which are of varying or changing diameter. The ingress end 31*a* has the largest diameter cavity therein and receives therein a separator insert 40. Separator insert 40 fits snugly in the cavity within the ingress end 31*a* of valve portion 31 and has two keys 40*a* extending outwardly from the outer end portion thereof that are received within two grooves 41 in the inner wall of the ingress end 31*a* to prevent separator insert 40 from rotating within valve portion 31 (FIG. 5*b*).

Main valve portion 31 has an upstanding hollow boss 42 formed integral therewith adjacent the ingress end 31*a* thereof. Separator insert 40 has an L-shaped passageway 43 therein, the vertical portion 43*a* of which is aligned and communicates with the passageway 42*a* through boss 42 and the horizontal portion 43*b* of which is adapted to be communicatively connected to the vapor return conduit in a fuel delivery hose of a service station pump (FIG. 5*b*).

Figure 6A:
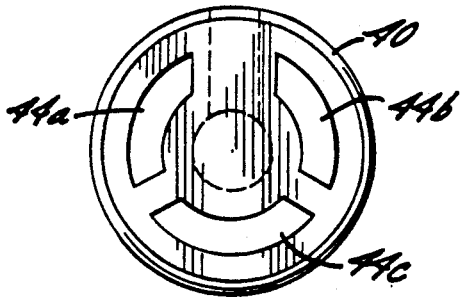
FIG. 6*a* is a transverse sectional view taken substantially along line 6*a*—6*a* in FIG. 5*b;*
Figure 6B:
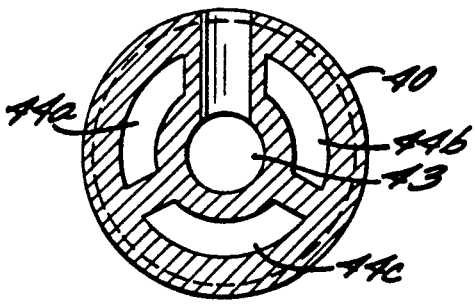
FIG. 6*b* is a transverse sectional view taken substantially along line 6*b*—6*b* in FIG. 5*b;*
Figure 7:
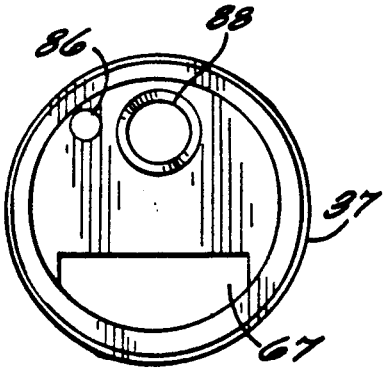
FIG. 7 is an end elevational view of the egress end of the main body portion looking in the direction of the arrows 7—7 in FIG. 5*b;*
Figure 8A:
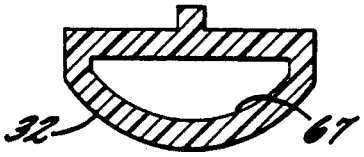
FIG. 8*a* is a transverse sectional view taken substantially along line 8*a*—8*a* in FIG. 5*b;*
Figure 8B:
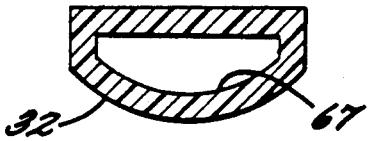
FIG. 8*b* is a transverse sectional view taken substantially along line 8*b*—8*b* in FIG. 5*b;*
Figure 8C:
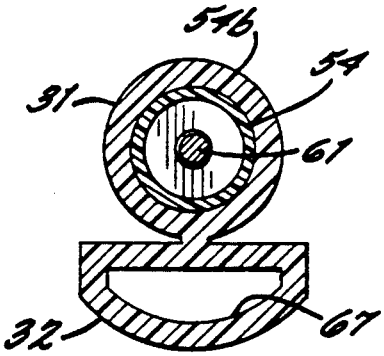
FIG. 8*c* is a transverse sectional view taken substantially along line 8*c*—8*c* in FIG. 5*b;*
Figure 8D:
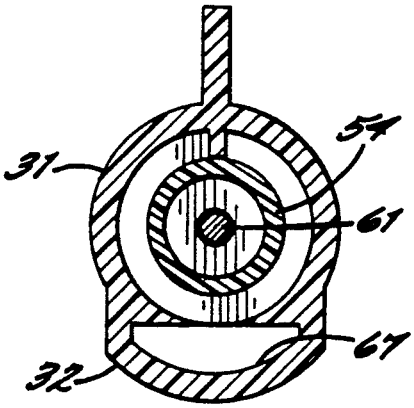
FIG. 8*d* is a transverse sectional view taken substantially along line 8*d*—8*d* in FIG. 5*b;*

Separator insert 40 has three arcuate openings 44*a*, 44*b* and 44*c* extending horizontally therethrough and which combine to define a fuel passageway 44 through separator insert 40 (FIGS. 6*a* and 6*b*). To properly seal separator insert 40 within the ingress end 31*a* of main valve portion 31, separator insert 40 has two spaced apart circumferential grooves 45, 46 around the outside periphery thereof and mounted in these circumferential grooves 45, 46 are O-rings 47 and 48 (FIG. 5*b*). It is noted that O-rings 47 and 48 are disposed on opposite sides of the vertical portion 43*a* of the passageway 43 in separator insert 40 and on opposite sides of the passageway 42*a* in boss 42.

A valve insert 50 is mounted in the hollow interior of main valve portion 31 of nozzle body member 30 behind or downstream of the separator insert 40. Valve insert 50 is hollow, but has the hollow interior 51 thereof formed with various diameter portions. The hollow interior of valve insert 50 has a relatively large diameter portion 51*a* at the end thereof closest to separator insert 40 and in communication with fuel passageway 44 through separator insert 40. Large diameter portion 51*a* defines a valve chamber, the inner end of which is formed into a valve seat 52.

The hollow interior 51 of valve insert 50 has a second portion 51*b* of reduced diameter from first valve portion 51*a* to define the valve seat 52 at the upstream end thereof and a shoulder valve seat 53 at the downstream end thereof (FIG. 5*b*). The next adjacent larger diameter portion 51*c* of the hollow interior 51 of valve insert 50 tapers outwardly at its upstream end and extends downstream for a predetermined distance. At the downstream end of interior portion 51*c*, there is a substantially reduced diameter interior portion 31*b* of the hollow interior of valve body portion 31 and a still further reduced diameter portion 31*c* which extends through the end wall 31*d* of valve body portion 31 opposite ingress end 31*a*.

A valve stem guide insert 54 is mounted in the hollow interior portion 31*b*. Guide insert 54 is hollow, but has its upstream end closed by an end wall 54*a* that extends outwardly beyond the body portion 54*b* of guide insert 54 to define a flange which has an O-ring seal 55 between the flange and the shoulder 56 between interior portions 51*c* and 31*b* to prevent the leakage of fuel around guide insert 54. End wall 54*a* has a central opening 57 therethrough for portion 31*c* in the end wall 31*d* of valve body portion 31.

The separator insert 40, valve insert 50 and stem guide insert 54 may be constructed of any suitable material. Preferably, separator insert 40 is die cast of a lightweight metal such as aluminum, while inserts 50 and 54 are formed of a plastic material, such as acetal.

The ingress end 31*a* of valve body member 31 is externally threaded and receives a separator lock nut 59 thereon. Lock nut 59 holds separator insert 40, valve insert 50 and stem guide insert 54 firmly in place within main valve member 31 (FIG. 3).

A main poppet valve 60 is mounted within the valve portion 51*a* of the hollow interior 51 of valve insert 50 and is carried by the inner end 61*a* of a valve stem 61 (FIG. 56). Main poppet valve 60 comprises a valve support member 60*a*, a valve sealing member 60*b*, made of a suitable elastomeric material, and a sealing member holder and mounting collar 60*c*.

The valve stem 61 extends through the aligned openings 57 and 31*c* and is supported by the end wall 54*a* of guide insert 54 and the end wall 31*d*. Suitable packing material 63 surrounds valve stem 61 within the hollow interior of guide insert 54 to prevent fuel from entering into guide insert 54 through the opening 57 in end wall 54*a*. Valve stem 61 carries a retaining ring 61*b* therearound within the hollow interior of guide insert 54 against which a pressure plate 64 rests. A compression spring 65 is positioned upstream of pressure plate 64 and downstream of the packing material 63. A pressure plate 66 is positioned between compression spring 65 and the packing material 63. In this manner, compression spring 65 serves to bias the valve stem 61 to the left as seen in FIGS. 3 and 5*b* such that the main poppet valve 60 is biased toward the closed position. At the same time, compression spring 65 exerts a compression force in the opposite direction against packing material 63 to maintain packing material 63 in full sealing engagement with the valve stem 61 and the end wall 54*a* of guide insert 54.

Fuel delivery portion 32 of nozzle body 30 has a longitudinal passageway 67 therethrough which communicates at its upstream end with the interior portion 51*c* of the hollow interior 51 of valve insert 50 and which extends through egress end 32*a* at its other end. Passageway 44 through separator insert 40, the hollow interior 51 of valve insert 50 and passageway 67 in fuel delivery portion 32 combine to form a fuel passageway through valve body 31 that extends therethrough in a generally straight line devoid of any abrupt changes in direction or substantial impediments to the flow of fuel therethrough.

A spout 70 is mounted on the egress end 21*d* of housing 21 and extends outwardly therefrom terminating in a free end portion 70*a*. Preferably, spout 70 is integrally formed and most preferably is extruded of a suitable lightweight metal, such as aluminum. Spout 70 has a fuel passageway 71 formed therein, a vapor recovery passageway 72 formed therein, and a shut-off passageway 73 similarly formed therein, with all of these passageways being formed integral within the spout 70. The fuel passageway 71 is the largest of the three passageways through spout 70, while vapor recovery passageway 72 is of intermediate size and shut-off passageway 73 is smaller than the vapor recovery passageway 72. All three passageways end in open ends at the free end portion 70*a* of spout 70, but vapor recovery passageway 72 has additional communication through spaced holes 74 in the side of spout 70 (FIG. 3). A strainer 75 is positioned in vapor recovery passageway 72 downstream of the holes 74.

Spout 70 is initially formed straight, but is bent intermediate its ends into a curved configuration for easy insertion of the free end portion 70*a* into the fill opening of a vehicle fuel tank (FIGS. 2 and 3). Also, while spout 70 may have a wall thickness uniform throughout, it is preferred that the outer wall thickness of spout 70 be initially formed thicker than the outer wall thickness for the free end portion 70*a* that will allow for insertion into the fill openings of vehicle fuel tanks. To form the free end portion 70*a*, this excess material is machined away to provide a free end portion 70*a* of the close tolerances required. The thicker material in the portion 70*b* of spout 70 provides added strength and stability to the spout 70.

The end of spout 70 mounted on the egress end 21*d* of housing 21 has a bell portion 70*c* thereon. The smaller end of the bell portion 70*c* is of the same diameter both externally and internally as the diameter of the spout portion 70*b*, while the larger end of bell portion 70*c* is of the same external diameter as the diameter of egress end 32*a* of fuel delivery portion 32 of nozzle body 30. Bell portion 70*c* may be formed integrally with the spout portion 70*b* or may be formed separately and attached to spout portion 70*b* (FIG. 3).

Spout 70 is mounted on the egress end 21*d* of housing 21 by being received within the outer end thereof and abutting against the egress end 32*a* of valve body 30. The egress end 21*d* of housing 21 is externally threaded 76 and a spout nut 77 is threadably received on the threaded portion 76. Spout nut 77 has an opening 78 therein through which the smaller end of bell portion 70*c* of spout 70 penetrates. An elastomeric gasket or spout gland 79 is positioned between spout nut 77 and the bell portion 70*c* of spout 70 to apply pressure to the bell portion 70*c* without deforming the same.

Mounted within the bell portion 70*c* of spout 70 is a spout connector assembly 80. The outer surface of spout connector assembly 80 is contoured to fit snugly within the bell portion 70*c*. Spout connector assembly 80 has an opening 81 therethrough which communicates with the fuel passageway 67 in fuel delivery portion 32 of nozzle body 30 at one end and with the fuel passageway 71 in spout 70 at its other end. Spout connector assembly 80 has a projecting boss 82 that extends outwardly from the side thereof opposite the spout 70 and penetrates through a hole 83 in the egress end 32*a* of fuel delivery portion 32 of nozzle body 30. Further, spout connector assembly 80 has an opening 84 therethrough and through boss 82 to permit vapors to pass through the spout connector assembly 80. A connector conduit 85 connects opening 84 in the spout connector assembly 80 to the vapor passageway 72 in spout 70.

Spout connector assembly 80 has a hole or passageway 86 therein which is connected to the shut-off passageway 73 in spout 70. Communication from the free end 70*a* of spout 70 through shut-off passageway 73 and the spout connector assembly 80 is thusly provided for reasons to be described hereinafter.

Projecting boss 82 on the spout connector assembly 80 has its inner end extending into a vapor recovery conduit or passageway 90 in the main housing portion 22 and in the handle 23. The opposite end of passageway 90 of handle 23 is slightly enlarged and receives therewithin boss 42 on valve body 30 such that the passageway 42*a* through boss 42 is in communication with the passageway 90 through handle 23 and main housing body 22. A vapor recovery passageway is thus provided within nozzle 20 by the combined passageway 72 in spout 70, the connector 85, opening 84 through spout connector assembly 80, passageway 90, passageway 42*a*, and passageway 43 in separator insert 40 (FIG. 3).

Figure 9A:
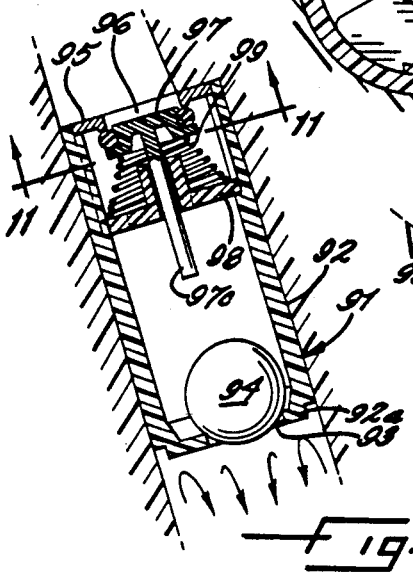
FIG. 9*a* is an enlarged sectional detail of the attitude responsive shut-off valve in the vapor recovery passageway of the handle portion of the nozzle as shown in the upper right hand portion of FIG. 3.
Figure 9B:
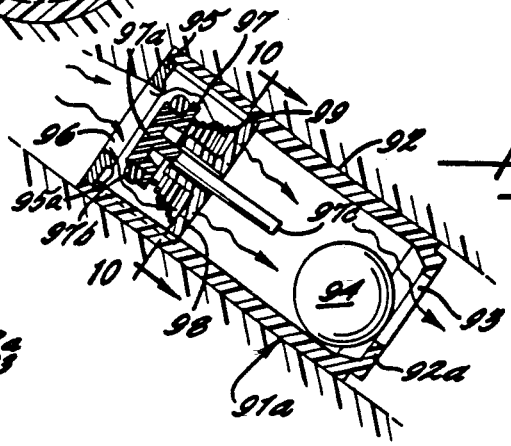
FIG. 9*b* is a sectional detail similar to FIG. 9*a* illustrating the operation of the attitude responsive shut-off valve with a change in attitude of the nozzle.

In addition, an attitude responsive valve 91 is mounted in the enlarged end portion of passageway 90 in handle 23 above boss 42. Attitude responsive valve 91 comprises a generally cylindrical casing 92 which is closed at one end by an end wall 92*a*, which has an opening 93 therethrough (FIGS. 9*a* and 9*b*). Opening 93 is offset upwardly from the longitudinal center line of casing 92 and the inner surface of end wall 92*a* surrounding opening 93 serves as a valve seat for a ball 94 confined within casing 92. When nozzle 20 is in a vertical attitude, such as when the same is hanging from a service station pump, the casing 92 will be only slightly inclined from the vertical (FIG. 9*a*) and ball 94 will roll onto the valve seat and close opening 93 in end wall 92*a*. Therefore, the vacuum being drawn on the vapor recovery passageway 90 by the vacuum assist within the service station pump will be prevented from passing the attitude responsive valve 91. When nozzle 20 is in a generally horizontal attitude, casing 92 will be almost horizontal and ball 94 will be displaced from opening 93 (FIG. 9*b*).

Figure 10:
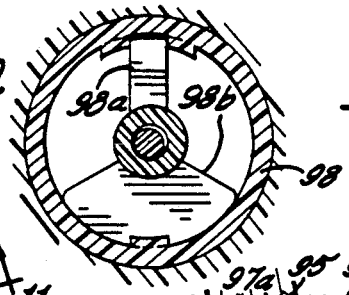
FIG. 10 is a transverse sectional view taken substantially along line 10—10 in Fig. 9*b;*
Figure 11:
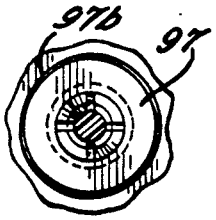
FIG. 11 is a transverse sectional view taken substantially along line 11—11 in Fig. 9*a;*

The opposite end of casing 92 is closed substantially by a valve plate 95 having a central opening 96 therein. The portion of valve plate 95 surrounding opening 96 on the interior of valve plate 95 defines a valve seat 95*a* against which a poppet valve 97 normally rests. Valve 97 comprises a rigid support member 97*a* and an elastomeric cylindrical member 97*b*, which rests against the valve seat 95*a*. Valve member 97*b* is carried by a valve stem 97*c*, which is mounted for reciprocating movement in a spider 98 mounted in casing 92 (FIGS. 9*a* and 9*b*). A compression spring 99 is disposed between spider 98 and valve support member 97*a* and serves to bias valve member 97*b* into sealing engagement with the valve seat 95*a*. Spider 98 only has two legs 98*a* and 98*b*, and vapors readily pass thereby when valve 97 is open and ball 94 is displaced from the opening 93 (FIG. 10). In this regard, it is noted that the vacuum assist drawn on passage 90 when ball 94 is displaced from opening 93 is sufficient to overcome the biasing action of spring 99 and to move valve member 97 away from its valve seat 95*a* to permit vapors to pass through the casing 92 into the remainder of passageway 90 in handle 23.

Nozzle 20 includes a shut-off mechanism for terminating the flow of fuel through the nozzle when the vehicle fuel tank is full. This shut-off mechanism includes the shut-off passageway 73 in spout 70, spout connector assembly 80 and an opening 88 in egress end 32*a* of fuel delivery portion 32 of nozzle body 30.

In addition, housing half 21*a* has a conduit 100 formed therein which communicates at one end with opening 88 in egress end 32*a* and at its other end with a vacuum chamber means 101 (FIGS. 3 and 5*a*). Vacuum chamber means 101 is formed by a cylindrical flange or wall 102 formed integral with housing half 21*a* and projecting outwardly from the inside of the side wall of main housing body 22 toward housing half 21*b*. The outer end of the cylindrical wall 102 is closed by a diaphragm assembly 103 which defines with wall 102 and the enclosed portion of the side wall of housing boy 22 a vacuum chamber 104 (FIGS. 5*b*, 19*a* and 19*b*).

Figure 19A:
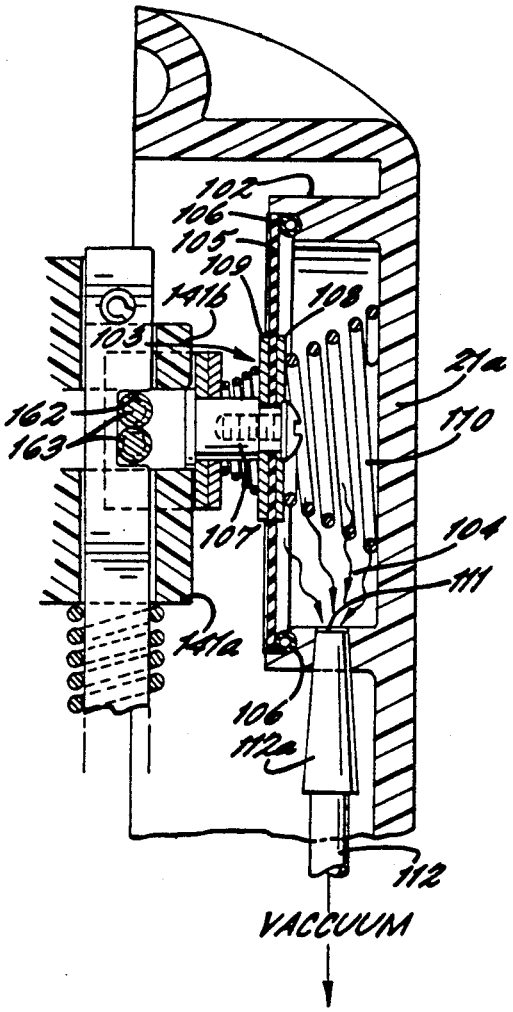
FIG. 19*a* is an enlarged fragmentary sectional view illustrating the vacuum chamber and diaphragm assembly when the shut-off passageway is not blocked.
Figure 19B:
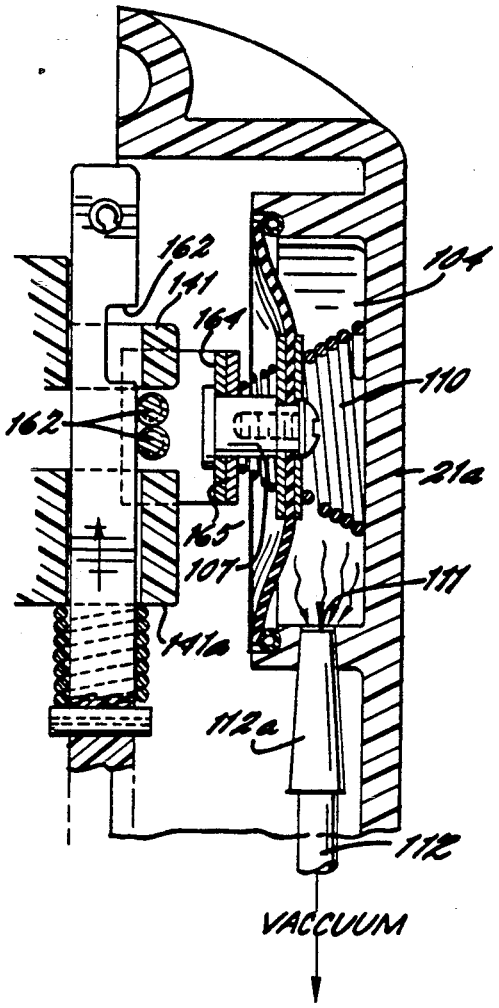
FIG. 19*b* is a view similar to FIG. 19*a* illustrating the vacuum chamber and diaphragm assembly when the shut-off passageway is blocked.

Diaphragm assembly 103 includes a diaphragm member 105 which engages an O-ring 106 disposed between diaphragm member 105 and the outer surface of cylindrical wall 102 (FIG. 19*a*). Diaphragm member 105 is mounted on a mounting member 107 by a pair of mounting plates 108 and 109. A compression spring 110 is positioned within the vacuum chamber 104 and engages the inner surface of the side wall of housing half 21*a* at one end and the diaphragm mounting plate 108 at its other end to bias diaphragm member 105 away from engagement with the cylindrical wall 102.

Cylindrical wall 102 has a hole 111 therethrough into which one end 112*a* of a venturi connector conduit is inserted. Venturi connector conduit 112 extends from vacuum chamber 104 to a boss 113 formed on nozzle body 30 immediately above the upstream end of the interior portion 51*c* of the hollow interior 51 of valve insert 50 (FIGS. 3 and 5*b*). An opening 114 extends through boss 113 and the wall of nozzle body 30 and communicates with a circumferential groove 115 in the outer surface of the valve insert 50. Groove 115 has a series of venturi openings 116 communicating therewith and extending through the outer wall of the valve insert 50 into the hollow interior 51 of valve insert 50 immediately downstream of the restricted diameter portion 51*b* and where interior portion 51*c* flares outwardly. Flow of fuel past the venturi openings 116 will create a venturi action therein which in turn will create a partial vacuum in the groove 115, the opening 114, venturi connector tube 112 and thence in vacuum chamber 104.

The venturi action created in venturi openings 116 by the flow of fuel therepast is enhanced by a flow restricting plug 120 loosely mounted on valve stem 61 and is biased into closing contact with the downstream end of the restricted diameter portion 51*b* of the hollow interior 51 of valve insert 50 immediately upstream from the venturi openings 116 by a compression spring 121. Flow-restricting plug 120 is frusto-conical such that the upstream end thereof extends into the restricted diameter portion 51*b* and the frusto-conical surface thereof firmly seats against the shoulder valve seat 53 and inner wall of the restricted diameter portion 51*b* of valve insert 50. The force of compression spring 121 is such that when main poppet valve 60 is open and fuel passes main poppet valve 60 and engages plug 120, the plug 120 will be forced to the left as seen in FIG. 5*b* away from its seat 53 by the pressure of the fuel thereon.

Restrictor plug member 120 has a motion-limiting extension 120*a* extending downstream from the frusto-conical portion thereof toward the upstream end wall 54*a* of valve stem mounting insert 54. Extension 120*a* thus limits the downstream movement of the flow-restricting plug 120 and insures that a restricted passageway is thus defined between the plug 120 and the interior wall of the valve insert 50 past the venturi openings 116. Thus, the venturi action of the flowing fuel is enhanced and the vacuum created thereby is increased.

Nozzle body 30 has an upstanding tab 130 formed integrally therewith. Tab 130 serves as one part of a mounting means for a valve-actuating assembly 131 and more specifically for a trigger member 132 of the valve-actuating assembly 131. Trigger member 132 is generally L-shaped and is pivotally mounted on tab 130 by a pivot pin 133 at the juncture between the vertical and horizontal legs 132*a*, 132*b* thereof (FIGS. 12*a*, 12*b* and 13*a*–13*c*). The vertical leg 132*a* of trigger member 132 extends upwardly and outwardly from the nozzle body 30 through an opening 134 in the top wall of the housing body 22 toward the section 23*c* of handle member 23 (FIG. 3). The upper end portion of the vertical leg 132*a* of trigger member 132 curves rearwardly and upwardly to the free end thereof which is disposed closely adjacent to the underneath side of portion 23*c* of trigger member 23. The upper end portion of the vertical leg 132*a* of trigger member 132 is positioned such that a user grasping the hand-grip portion 23*b* of handle 23 may readily engage and operate the trigger member 132 with his or her forefinger or forefinger and middle finger (FIG. 2).

Figure 13A:
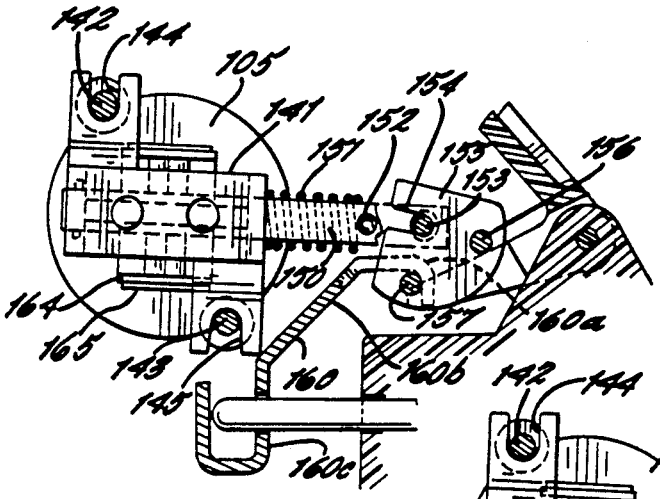
FIG. 13*a* is an enlarged sectional detail of the trigger linkage mechanism connecting the trigger to the valve stem of the main poppet valve.
Figure 13B:
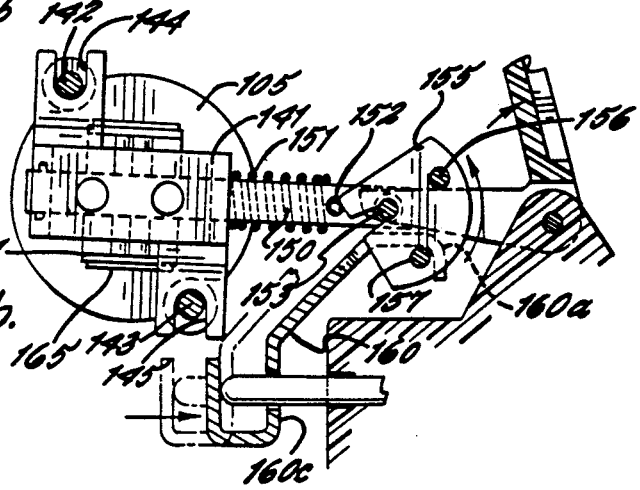
FIG. 13*b* is a view similar to FIG. 13*a* showing the trigger linkage mechanism in valve open position.
Figure 13C:
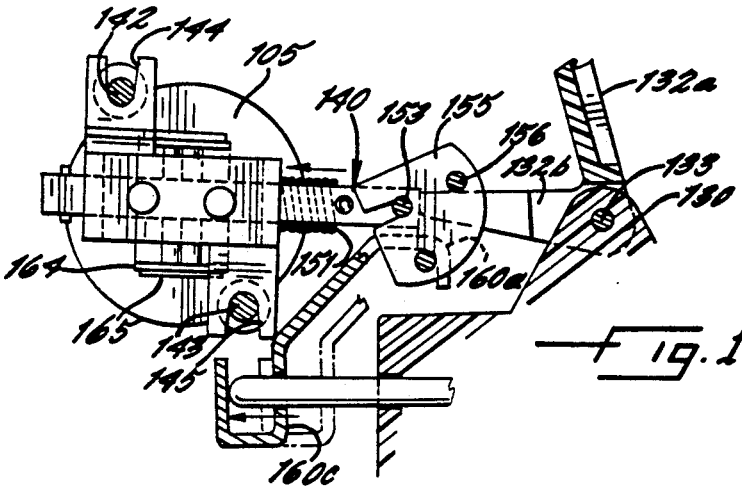
FIG. 13*c* is a view similar to FIGS. 13*a* and 13*b* showing the trigger linkage being disconnected from the main poppet valve and thereby permitting the main poppet valve to close.

The horizontal leg 132*b* of trigger member 132 extends generally horizontally of the nozzle body 30 toward the spout 70 for a predetermined distance. A trigger linkage assembly 140 is provided for connecting the trigger member 132 and specifically the horizontal leg 132*b* thereof to the valve stem 61 of the main poppet valve 60. The trigger linkage assembly 140 is best shown in FIGS. 13*a*, 13*b*, 13*c*, 15, 16 and 17 and comprises a square guide insert or mounting member 141, which is stationarily mounted on housing half 21*b* by screws 142, 143 penetrating through slots 144 and 145 in opposite end portions of the guide insert or mounting member 141 and cut into blind holes in bosses 146, 147 formed integral with housing half 21*b* (FIGS. 13*a* and 16).

The medial portion of square guide insert 141 has two projecting portions 141*a* and 141*b* which project toward the vacuum chamber means 101 on housing half 21*a*. Projecting portions 141*a* and 141*b* are spaced apart and have aligned square openings 148 and 149 therethrough which slidably receive in guiding relation a square stem 150. Square stem 150 is biased toward the trigger member 132 by a compression spring 151 which rests against the projecting portion 141*a* at one end and against a spring pin 152 mounted in square stem 150 at its other end.

Square stem 150 has a roller pin 153 mounted in the end portion thereof closest to trigger 132. Roller pin 153 is received in a slot 154 in a roller link 155 such that roller link 155 is pivotally mounted on square stem 150 (FIGS. 13*a* and 15).

Roller link 155 also has mounted thereon a roller pin 156 which is engageable with the upper surface of the horizontal leg 132*b* of trigger member 132 such that trigger member 132 may be operated to pivot roller link 155 about roller pin 153 on square stem 150.

Roller link 155 also has mounted thereon a roller pin 157 which is spaced from both roller pins 153 and 156. A rod link 160 is connected at its upper end to roller pin 157 by having a hook 160*a* in the upper end portion thereof which hooks over and rests on the roller pin 157. Rod link 160 has the medial portion 160*b* extending downwardly and outwardly to a position overlying the outer end of the valve stem 61. The lower portion 160*c* is U-shaped with one leg thereof having a hole 161 therein through which the outer end portion of valve stem 61 penetrates. The end of valve stem 61 rests against the other leg of U-shaped end portion 160*c* of rod link 160. Thus main poppet valve 60 is connected to trigger member 132 through rod link 160, roller pin 157, roller link 155 and roller pin 156.

Square stem 150 has a vertically extending, laterally opening slot or groove 162 therein, which faces toward the diaphragm assembly 103 (FIGS. 19*a* and 19*b*). Groove 162 normally receives and has disposed therein a pair of roller pins 163 to lock square stem 150 within the square guide insert 141 against sliding or reciprocatory movement therein. The square stem 150 is held stationary by the roller pins 163 and roller pin 153 is also held stationary and thereby becomes the pivot point for roller link 155.

Roller pins 163 are mounted at their opposite ends in slots in the legs of a generally U-shaped inner roller cage 164 which is mounted on the mounting member 107 of the diaphragm assembly 103. The U-shaped legs of inner roller cage 164 extend outwardly from the mounting member 107 into straddling relation to the square stem mounting projections 141*a* and 141*b* of the square guide insert 141 such that the roller pins 163 are disposed within the space between the square stem mounting projections 141*a* and 141*b* and into the slot or groove 162 in square stem 150. Inner roller cage 164 is surrounded by an outer roller cage 165 mounted on mounting member 107 of diaphragm assembly 103 for sliding movement therealong. Outer roller cage 165 is also U-shaped and has its opposite leg portions 165*a* and 165*b* normally in contact with opposite ends of the roller pins 163 to hold the roller pins 163 in operative position within inner roller cage 164 and within the groove 162 of square stem 150. A compression spring 166 is disposed between diaphragm member 105 and the outer roller cage 165 to bias the roller cage 165 into surrounding engagement with the inner cage 164.

Figure 12A:
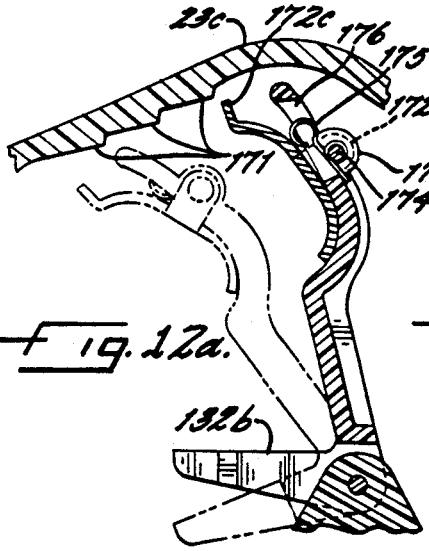
FIG. 12*a* is an enlarged sectional detail of the trigger mechanism shown in the upper medial portion of FIG. 3 with the different positions illustrated therein.
Figure 12B:
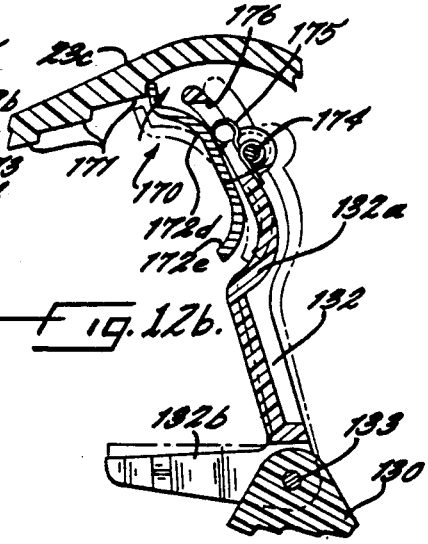
FIG. 12*b* is a view similar to FIG. 12*a* illustrating the operation of the series of spaced projections and the hold-open clip carried by the trigger mechanism.
Figure 12C:
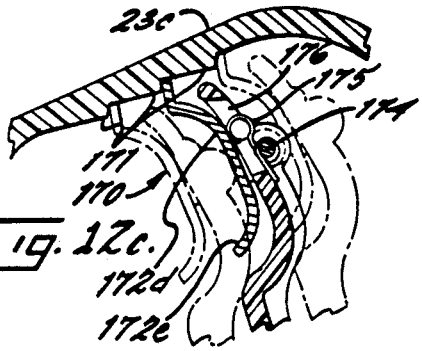
FIG. 12*c* is an enlarged sectional detail of the upper portion of the trigger mechanism illustrating the hold-open latch feature thereof.

The main poppet valve-actuating assembly 131 includes a hold-open latch mechanism generally indicated at 170 in FIGS. 12*a*, 12*b* and 12*c*. Hold-open latch assembly 170 includes a series of spaced projections 171 formed integrally with the underside of handle portion 23*c* of handle member 23. The projections 171 are so located on handle portion 23*c* and are spaced apart a distance such that when the trigger member 132 is moved to open the main poppet valve 60, the projections will lie immediately above the outer end of the trigger member 132.

A hold-open latch member 172 is mounted on the outer end portion of the trigger member 132. Hold-open latch member 172 is elongate and includes two rearwardly extending mounting brackets 172*a* and 172*b* which straddle the outer end portion of trigger member 132. Trigger member 132 also has a rearwardly extending boss 173 thereon and the latch member 172 is mounted to trigger 132 by a pivot pin 174.

A torsion spring 175 is mounted on pivot pin 174 and engages the outer portion of latch member 172 through an opening 176 in the outer end portion of trigger member 132. Torsion spring 175 thus biases latch member 172 forwardly and downwardly about pivot pin 174 such that the outer end portion 172*c* of latch member 172 will normally clear and not engage with the projections 171 on handle portion 23*c*. The latch member 172 has the portions 172*d* and 172*c* thereof above and below the mounting brackets 172*a* and 172*b* curved so as to provide spaced-apart grasping portions for the forefinger or forefinger and middle finger of the hand of a user.

If a user does not wish to activate the hold-open latch assembly 170 to latch trigger member 132 in one of three open positions, the user then operates the trigger member 132 by grasping the latch member 172 below the pivot point 174 at grasping portion 172*e* and pulls rearwardly on the trigger member 132 to open the main poppet valve 60. With latch member 172 in the position shown in FIG. 12*a*, the upper end portion 172*c* of latch member 172 will not engage the projections 171 and the trigger member 132 will not be latched in any of its open positions. However, if it is desired to engage the hold-open latch assembly 170, the user grasps the latch member 172 at grasping portions 172*d* above the pivot pin 174. Upon rearward pulling movement on trigger member 132 at grasping portion 172*d*, the latch member 172 will be pivoted about pivot pin 174 against the action of torsion spring 175 causing the end portion 172*c* of latch member 172 to engage any desired one of the projections 171. The trigger member 132 will thus be latched in any one of the three open positions thereof corresponding to the flow rate of fuel desired by the user (FIG. 12*c*).

Figure 14A:
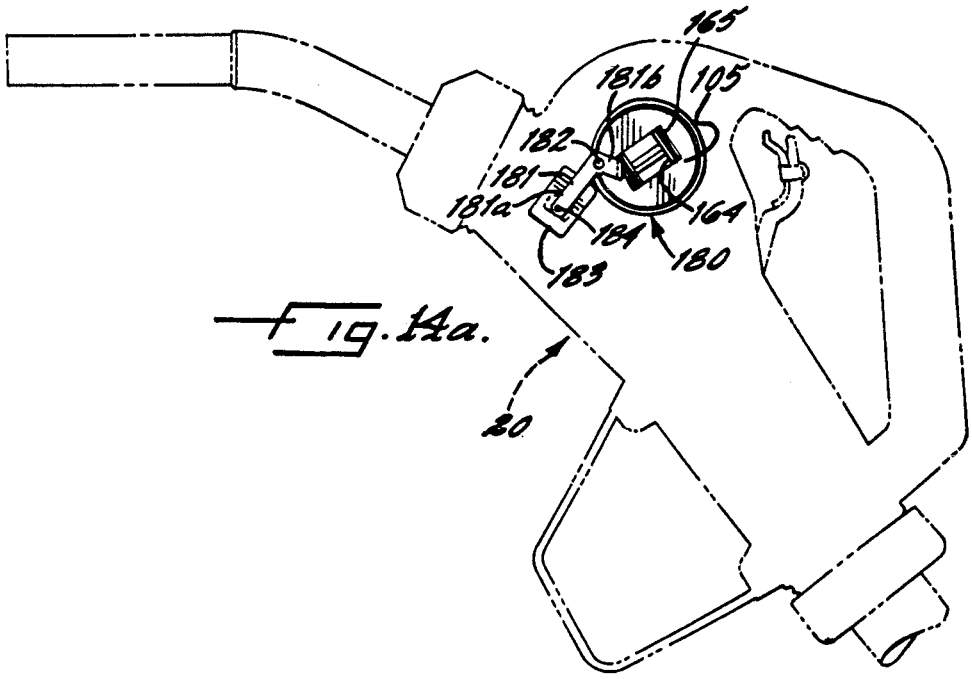
FIG. 14*a* is a partial sectional view with the nozzle shown in phantom lines illustrating the attitude responsive disconnect mechanism in a disconnect position.
Figure 14B:
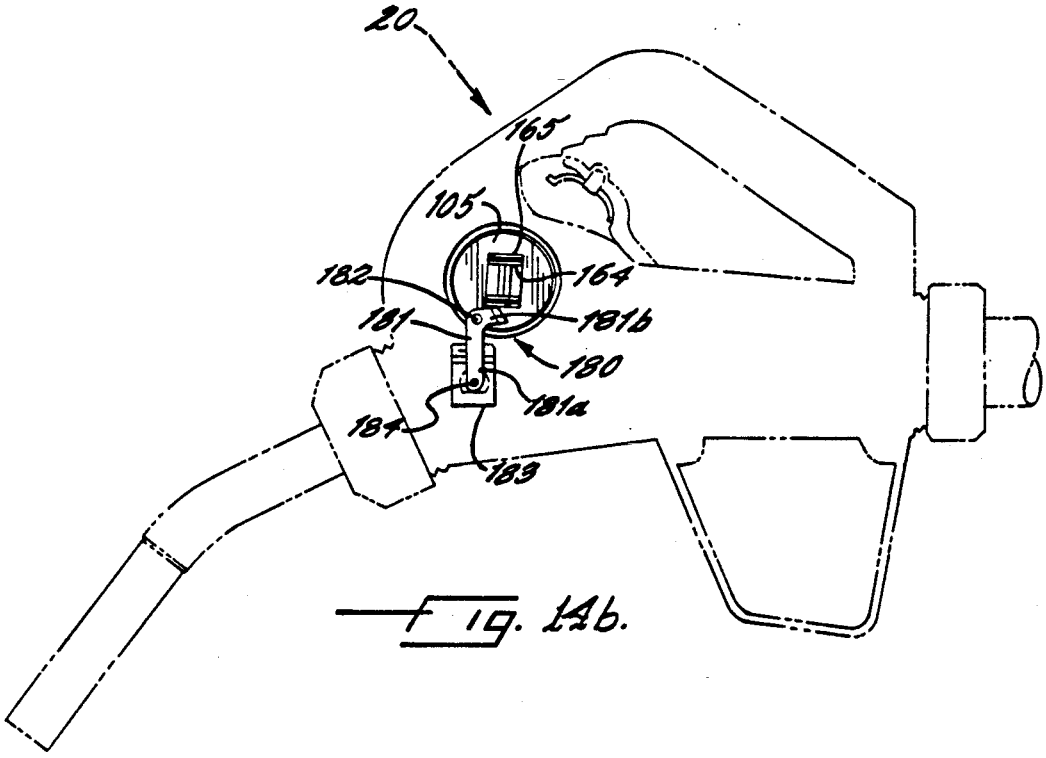
FIG. 14*b* is a view similar to FIG. 14*a* showing the attitude responsive disconnect mechanism in non-disconnect position.

Nozzle 20 includes an attitude responsive means 180 which disconnects trigger member 132 and the trigger linkage 131 from the main poppet valve 60 when the nozzle 20 is in an attitude other than the attitude with spout 70 pointing downwardly as when the nozzle 20 is in a position corresponding to that in which the outer end portion 70*a* of spout 70 is inserted within the fill opening of a vehicle fuel tank (FIGS. 2, 14*a* and 14*b*). Attitude responsive disconnect means 180 comprises a generally L-shaped member 181 that is pivotally mounted on housing half 21*b* by a pivot pin 182. The vertical leg 181*a* of L-shaped member extends vertically downwardly from pivot pin 182 and has a weight 183 mounted thereon by a pin 184.

The horizontal leg 181*b* of L-shaped member 181 has a transversely extending cam portion 181*c* extending outwardly therefrom toward housing half 21*a* and toward the vacuum chamber means 101 (FIGS. 16 and 17). The outer end surface of cam portion 181*c* is angled from top to bottom as seen in FIG. 17 and engages against the outer end of one of the legs of the outer roller cage 165. As the attitude of nozzle 20 changes, L-shaped attitude responsive disconnect member 181 will rotate about pivot pin 182 under the impetus of the weight 183 to move the cam portion 181*c* relative to the lowermost leg of the outer cage member 185 (FIGS. 14*a* and 14*b*). The cam surface on cam portion 181*c* thus will force the outer cage member 185 toward the diaphragm assembly 103 against the action of compression spring 166 to move the roller pins 163 out of the groove 162 in the square stem 150 to disconnect square stem 150 from the guide insert 141 such that the square stem may slide freely in the guide projections 141*a* and 141*b* (FIG. 17).

The trigger linkage 131 connecting the trigger member 132 to the valve stem 61 is thereby rendered inoperative and operation of the trigger while the roller pins 163 are out of the groove 162 in square stem 150 will not open the main poppet valve 60. Once the nozzle 20 is returned to the attitude corresponding to the position the nozzle is in when the outer spout portion 70*a* is within the fill opening of a vehicle tank (FIG. 14*b*), the attitude responsive disconnect member 181 will rotate back to a position where the cam surface on cam portion 181*c* is not forcing outer cage member 165 toward diaphragm assembly 103 and this will permit the roller pins 163 to return to groove 162 fastening square stem 150 to the guide insert 141 and reactivating the trigger linkage 131 and reconnecting the trigger member 132 to the valve stem 61 (FIGS. 18*a*, 18*b* and 18*c*).

In operation, nozzle 20 will be connected to the outer end of a fuel delivery hose of a service station pump which in turn is connected to an underground fuel tank. The fuel delivery hose and the service station pump are not part of this invention, but the fuel delivery hose should include both a fuel conduit and a vapor recovery conduit therein and the service station pump should include a vacuum assist connected to the vapor recovery conduit of the hose.

When not in use, nozzle 20 will be mounted on the service station pump by having the hanger 24 hooked over the nozzle hanger mechanism provided on the service station pump. Such service station pumps typically have a nozzle repository thereon which includes a cavity into which the spout 70 and the hanger 24 are received. In this position on the service station pump, nozzle 20 has the handle 23 extending outwardly in position to be readily grasped by the hand of a user.

In such a position, nozzle 20 would be in a vertical orientation, as is shown in FIG. 14*a*, and the attitude responsive disconnect mechanism 180 will operate to render the trigger linkage assembly 140 inoperable to prevent the main poppet valve 60 from being opened and fuel inadvertently or accidentally dispensed through nozzle 20. Similarly, the attitude responsive vapor recovery valve 91 will be operable to close the vapor recovery passage 90 through nozzle 20 to ensure that air will not pass through nozzle 20 into the underground storage tank when nozzle 20 is resting on the service station pump.

When a user desires to use nozzle 20, he or she may grasp the handle 23 by the hand-grip portion 23*b* and remove the nozzle 20 from the service station pump. The particular angle and ergonomic design of handle member 23 is such that when a user grasps nozzle 20 even in the vertical orientation, the user's hand, wrist and forearm remain substantially straight and in a very comfortable position. Therefore, the user may grasp and remove the nozzle from the service station pump without any strain or other difficulty. Similarly, the design and particular angle of hand-grip portion 23*b* of handle 23 is such that when the user manipulates the nozzle 20 into a horizontal attitude to position the outer end portion 70*a* of spout 70 in the fill opening of a vehicle fuel tank, the hand, arm and wrist of the user does not have to be substantially flexed to move the nozzle 20 into a proper operative position.

The user inserts the free-end portion 70*a* of spout 70 of nozzle 20 into the fill opening of the vehicle fuel tank, and the nozzle 20 is then in position to dispense fuel into the vehicle fuel tank. When nozzle 20 is moved to this position, the attitude responsive disconnect means 180 moves to the inoperative position and the trigger linkage 131 again connects the trigger member 132 to valve stem 61 of main poppet valve 60.

The trigger member 132 is in a readily accessible position to the forefinger or forefinger and middle finger of the user's hand such that the user need only grasp the trigger member 132 and pull rearwardly thereon to commence the dispensing of fuel through nozzle 20 into the vehicle fuel tank. The user may choose to dispense fuel into the vehicle fuel tank manually and without utilization of the hold-open mechanism 170. To do this, the user grasps the trigger member 132 by engaging the fingers with the grasping portion 172*e* of latch member 172 which retains latch member 172 in the inoperative or inactive position and the hold-open open mechanism 170 will not be operable. However, if the user wishes to utilize the hold-open feature, the user will grasp the trigger member 132 at grasping portion 172*d* of latch member 172. Therefore, when the user pulls rearwardly on trigger member 132, latch member 172 will be pivoted about pivot pin 174 and against the action of torsion spring 175 into operative position and will engage the desired one of the spaced projections 171 to latch the trigger member 132 in the desired open position determined by the desired flow rate of fuel through the nozzle 20 into the vehicle fuel tank.

Such rearward movement of trigger member 132 operates the trigger linkage mechanism 131 to open main poppet valve 60 and cause fuel to flow through the fuel passageway in nozzle 20 and out of the open end of spout 70. Once the fuel tank of the vehicle becomes full, the fuel in the tank will block the open outer end of shut-off passageway 73 in nozzle 70 such that the venturi action caused by flow of fuel past the venturi openings 116 in nozzle 120 will be increased and the vacuum drawn on vacuum chamber 104 will greatly increase. Such increased vacuum will cause the diaphragm assembly 103 to be drawn into the vacuum chamber 104 which will operate the trigger linkage disconnect mechanism to disconnect the trigger member 132 from the main poppet valve stem 61 and thereby permitting the main poppet valve 60 to close and terminate the flow of fuel through the nozzle 20.

The nozzle 20 removes vapors from the fuel tank by the vacuum assist of a pump pulling a vacuum on the vapor recovery passageway defined in nozzle 20 by the passage 72 in spout 70, passage 90 in housing 21, and the remainder of the passages for vapor recovery. Such vapor recovery continues until the fuel flow ceases.

In the drawings and specifications, there has been set forth a preferred embodiment of the invention, and although specific terms are employed, they are used in a generic and descriptive sense only and not for purposes of limitation.

That which is claimed is:

1. A fuel dispensing nozzle characterized by improved user friendliness comprising:

(a) a main body portion having a fuel passageway extending from an ingress end of the main body portion to an egress end thereof substantially along the longitudinal axis of said body portion, the ingress end of said main body portion being adapted to be connected to a hose for delivering fuel from a pump to said nozzle, said main body portion having top and bottom portions substantially parallel to said fuel passageway, (b) a spout carried by the egress end of said main body portion and extending outwardly and downwardly therefrom, said spout including a fuel dispensing passageway extending therethrough and being communicatively connected to said fuel passageway in said main body portion for dispensing fuel into a vehicle fuel tank, (c) main valve means mounted in said main body portion for controlling the flow of fuel through the fuel passageway in said main body portion, (d) handle means carried by the top portion of said main body portion and extending outwardly and upwardly therefrom and having a grasping portion spaced upwardly from said main body portion, and (e) main valve actuating means mounted on said main body portion and operatively connected to said main valve means for opening said main valve means to dispense fuel through said nozzle, said main valve actuating means including trigger means extending upwardly through the top portion of said main body portion toward said grasping portion of said handle means for ready access to a user holding said nozzle by said handle means, whereby said nozzle may be readily grasped by a user while the nozzle is disposed on a dispensing pump and manipulated to dispense fuel into a vehicle fuel tank without the hand of the user coming into contact with the main body portion of the nozzle.

2. A fuel dispensing nozzle according to claim 1 wherein said main body portion is elongated and said grasping portion of said handle means extending outwardly and upwardly from the top of said main body portion at an acute angle relative the longitudinal axis of said main body portion.

3. A fuel dispensing nozzle according to claim 1 wherein said handle means is elongate and is connected at opposite ends thereof to said main body portion of said nozzle at spaced apart locations.

4. A fuel dispensing nozzle according to claim 3 wherein said grasping portion of said handle means extends outwardly from said main body portion at an acute angle thereto and the remainder of said handle means extends inwardly from the outer end of said grasping portion to said main body portion at an acute angle to said main body portion.

5. A fuel dispensing nozzle according to claim 3 wherein said handle means has a series of spaced projections on the side thereof facing and adjacent to said trigger means, and including clip means carried by said trigger means for selective engagement with one of said projections for holding said trigger means in main valve actuating position.

6. A fuel dispensing nozzle according to claim 5 wherein said clip means is elongate and is pivotally mounted on said trigger means at a medial location therealong, said clip means having a first end portion adjacent said handle means which when engaged by a finger of a user operating said trigger means will pivot toward the outer end of said trigger means and into operative engagement with said series of spaced projections and a second end portion distal from said handle means which when engaged by the finger of a user operating said trigger means will pivot said first end portion away from the outer end of said trigger means and said series of projections.

7. A fuel dispensing nozzle according to claim 6 including means for biasing said clip means away from the outer end of said trigger means and said series of projections.

8. A fuel dispensing nozzle according to claim 1 wherein said main body portion is elongate and said fuel passageway therein provides a generally straight fuel flow path devoid of abrupt changes of direction.

9. A fuel dispensing nozzle according to claim 8 wherein said main valve means moves longitudinally of said main body portion between its open and closed positions.

10. A fuel dispensing nozzle according to claim 9 wherein said main valve means includes a valve seat surrounding said fuel passageway, a valve member within said fuel passageway and cooperating with said valve seat for closing said passageway when seated on said valve seat and for opening said passageway when moved away from said valve seat, a valve stem connected at one end to said valve member and being mounted for reciprocating, longitudinal movement in said main body portion and projecting outwardly of said main body portion at its other end, and means biasing said valve stem and valve member toward said valve seat and closed position.

11. A fuel dispensing nozzle according to claim 1 wherein said nozzle includes shut-off means for stopping the flow of fuel through said fuel passageway in said nozzle when the vehicle fuel tank is full.

12. A fuel dispensing nozzle according to claim 11 wherein said shut-off means includes venturi means communicating at one end with said fuel passageway in said main body portion and with a vacuum chamber at its other end for creating a vacuum in said vacuum chamber in response to fuel flow through said fuel passageway, a shut-off passageway in said spout communicating with the open outer end of said spout at one end thereof and with said vacuum chamber at the other end thereof, and vacuum responsive means operatively associated with said vacuum chamber and connected to said trigger means for disconnecting said trigger means from said main valve means upon a predetermined vacuum being created in said vacuum chamber.

13. A fuel dispensing nozzle according to claim 1 including attitude responsive means for disconnecting said trigger means from said main valve means when said nozzle is not in the proper attitude for insertion of the outer end portion of said spout into the fill opening of a vehicle fuel tank and for reconnecting said trigger means to said main valve means when said nozzle is in the proper attitude whereby the dispensing of fuel through said nozzle is prevented except when said nozzle is in the proper attitude for the dispensing of fuel into a vehicle fuel tank.

14. A fuel dispensing nozzle characterized by improved user friendliness comprising:

(a) a housing comprising an elongate, hollow main housing portion open at its opposite ends and having top and bottom wall portions extending substantially parallel to the longitudinal axis of said main housing portion and an elongate handle portion connected at its opposite ends to said top wall portion of said main housing portion with the medial portion of said handle portion being spaced upwardly from said top wall portion of said main housing portion to define a hand grip adapted to be grasped by a user, (b) an elongate nozzle body portion mounted within said main housing portion and having a fuel passageway extending from an ingress end of said nozzle body portion to an egress end thereof substantially parallel to the longitudinal axis of said main housing portion, the ingress end of said nozzle body portion extending out of one open end of said main housing portion and being adapted to be connected to a hose for delivering fuel from a pump to said nozzle, said egress end of said body portion communicating with the other open end of said main housing portion, (c) a spout carried by said main housing portion and extending outwardly and downwardly therefrom said spout including a fuel dispensing passageway therethrough communicatively connected to said fuel passageway in said nozzle body portion for dispensing fuel into a vehicle fuel tank, (d) valve means mounted in said nozzle body portion for controlling the flow of fuel through said fuel passageway in said body portion, and (e) valve actuating means mounted on said nozzle body portion and connected to said valve means for operating said valve means to dispense fuel through said nozzle, said valve actuating means including trigger means extending upwardly from said body portion through said top wall portion of said main housing portion and toward said handle portion for ready access to a user holding said nozzle by said handle portion, whereby said nozzle may be grasped and used by a user without the hand of the user coming into contact with any portion of said nozzle through which fuel passes.

15. A fuel dispensing nozzle according to claim 14 wherein said housing further includes a hanger portion mounted on said bottom wall portion and extending downwardly therefrom for hanging said nozzle on a pump when not in use.

16. A fuel dispensing nozzle according to claim 15 wherein said hanger portion is removably mounted on said main housing portion for removal and replacement with a hanger portion of a configuration corresponding to a particular pump with which said nozzle is to be used.

17. A fuel dispensing nozzle according to claim 14 wherein said housing is molded of a composite resin.

18. A fuel dispensing nozzle according to claim 14 wherein said nozzle body portion is molded of a composite resin.

19. A fuel dispensing nozzle according to claim 14 wherein said hand-grip portion of said handle portion of said housing is disposed at an acute angle to the longitudinal axis of said main housing portion.

20. A fuel dispensing nozzle characterized by increased safety and environmental protection, said nozzle comprising:

(a) a main body portion having a fuel passageway extending from an ingress end of said main body portion to an egress end thereof, the ingress end of said main body portion being adapted to be connected to a hose for delivering fuel from a pump to said nozzle, (b) a spout carried by the egress end of said main body portion and extending outwardly therefrom, said spout including a fuel dispensing passageway extending therethrough and being communicatively connected to said fuel passageway in said main body portion for dispensing fuel into a vehicle fuel tank, (c) main valve means mounted in said main body portion for controlling the flow of fuel through said fuel passageway in said main body portion, (d) main valve actuating means mounted on said main body portion and operatively connected to said main valve means and adapted to be operated by a user for actuating said main valve means to dispense fuel through said nozzle, and (e) attitude responsive means mounted in said nozzle and operatively connected to said main valve actuating means for preventing said main valve from being opened by said main valve actuating means except when said nozzle is in an attitude corresponding to the proper position for dispensing fuel into a vehicle fuel tank, whereby the inadvertent dispensing of fuel from said nozzle is prevented when the nozzle is not in proper position for dispensing fuel into a vehicle fuel tank.

21. A fuel dispensing nozzle according to claim 20 wherein said attitude responsive means comprises a pendulum-like member pivotally mounted adjacent the upper end thereof, a weight mounted on said member adjacent the lower end thereof, and disconnect means connected to said valve actuating means for deactivating said valve actuating means when said nozzle is not in the proper attitude for dispensing fuel.

* * * * *

UNITED STATES PATENT AND TRADEMARK OFFICE

CERTIFICATE OF CORRECTION

PATENT NO. : 5,327,949

DATED : July 12, 1994

INVENTOR(S) : Kenneth W. Dotson et al.

It is certified that error appears in the above-identified patent and that said Letters Patent is hereby corrected as shown below:

Column 7, line 65, delete "for" and insert
-- aligned with --.

Column 8, line 12, delete "(FIG. 56)" and insert
-- (FIG. 5b) --.

Column 10, line 66, delete "boy" and insert
-- body --.

Signed and Sealed this

Second Day of May, 1995

Bruce Lehman

*Attest:*

BRUCE LEHMAN

*Attesting Officer*

*Commissioner of Patents and Trademarks*